US008256398B2

(12) United States Patent
Akita et al.

(10) Patent No.: US 8,256,398 B2
(45) Date of Patent: Sep. 4, 2012

(54) FUEL SUPPLY APPARATUS AND FUEL SUPPLY METHOD OF AN INTERNAL COMBUSTION ENGINE

(75) Inventors: Tatsuhiko Akita, Okazaki (JP); Naoki Kurata, Nishikamo-gun (JP)

(73) Assignee: Toyota Jidosha Kabushiki Kaisha, Toyota (JP)

( * ) Notice: Subject to any disclaimer, the term of this patent is extended or adjusted under 35 U.S.C. 154(b) by 622 days.

(21) Appl. No.: 12/308,856

(22) PCT Filed: Jun. 19, 2007

(86) PCT No.: PCT/IB2007/001634

§ 371 (c)(1),
(2), (4) Date: Dec. 24, 2008

(87) PCT Pub. No.: WO2008/001176

PCT Pub. Date: Jan. 3, 2008

(65) Prior Publication Data

US 2009/0183711 A1 Jul. 23, 2009

(30) Foreign Application Priority Data

Jun. 29, 2006 (JP) ..... 2006-180154

(51) Int. Cl.
*F02M 63/00* (2006.01)
*F02M 37/06* (2006.01)
*F02M 57/02* (2006.01)

(52) U.S. Cl. ..... 123/334; 123/198 D; 123/446; 123/332; 123/457; 123/511

(58) Field of Classification Search ..... 123/319, 123/321, 322, 329, 332, 333, 339.15, 344, 123/345, 346, 347, 390, 446, 506, 198 C, 123/198 D, 334, 335, 348, 406.15, 406.23, 123/406.45, 406.47, 406.59, 457, 458, 459, 123/511, 514, 445, 447, 510, 512, 513; 701/104, 701/110, 114
See application file for complete search history.

(56) References Cited

U.S. PATENT DOCUMENTS

| | | | | |
|---|---|---|---|---|
| 4,153,019 | A * | 5/1979 | Laubenstein et al. | 123/406.29 |
| 5,181,493 | A | 1/1993 | Motoyama et al. | |
| 5,201,294 | A * | 4/1993 | Osuka | 123/458 |
| 5,727,516 | A * | 3/1998 | Augustin et al. | 123/198 DB |
| 6,192,856 | B1 * | 2/2001 | Shioi et al. | 123/300 |
| 6,237,573 | B1 * | 5/2001 | Onishi et al. | 123/506 |

(Continued)

FOREIGN PATENT DOCUMENTS

EP 0 375 944 A2 7/1990

(Continued)

*Primary Examiner* — Stephen K Cronin
*Assistant Examiner* — Raza Najmuddin
(74) *Attorney, Agent, or Firm* — Oliff & Berridge, PLC

(57) ABSTRACT

A high-pressure pump (50) is provided which is drivingly connected to an engine output shaft (1) and delivers fuel to an injector (4) through a delivery pipe (5) based on the rotation of the output shaft (1). The high-pressure pump (50) includes an electromagnetic valve (50*b*) that adjusts, based on the engine operating state, a fuel delivery amount within an adjustable range that changes according to a rotation speed of the engine output shaft (1). When an abnormality is detected in the electromagnetic valve (50*b*), the rotation speed of the engine output shaft (1) is restricted to equal to or less than a reference engine speed (NT).

20 Claims, 10 Drawing Sheets

U.S. PATENT DOCUMENTS

| | | | | |
|---|---|---|---|---|
| 6,484,692 | B2 * | 11/2002 | Umemoto et al. | 123/335 |
| 6,668,791 | B2 * | 12/2003 | Tetsuno et al. | 123/295 |
| 6,715,468 | B2 * | 4/2004 | Uchiyama et al. | 123/339.15 |
| 6,871,633 | B1 * | 3/2005 | Date et al. | 123/447 |
| 6,948,480 | B2 | 9/2005 | Eser et al. | |
| 7,028,667 | B2 * | 4/2006 | Hori | 123/446 |
| 7,100,574 | B2 * | 9/2006 | Otani | 123/456 |
| 7,185,627 | B2 * | 3/2007 | Shibagaki | 123/308 |
| 7,293,548 | B2 * | 11/2007 | Oono | 123/446 |
| 7,401,593 | B2 * | 7/2008 | Rembold et al. | 123/467 |
| 7,546,832 | B2 * | 6/2009 | Okamoto et al. | 123/506 |
| 2005/0183699 | A1 * | 8/2005 | Otani | 123/457 |
| 2005/0257775 | A1 * | 11/2005 | Kojima | 123/458 |

FOREIGN PATENT DOCUMENTS

| | | | | |
|---|---|---|---|---|
| EP | 0 501 463 | A2 | | 9/1992 |
| JP | 10141178 | A | * | 5/1998 |
| JP | 2000008997 | A | * | 1/2000 |
| JP | A-2000-8997 | | | 1/2000 |
| JP | A-2000-130232 | | | 5/2000 |
| JP | 2002195129 | A | * | 7/2002 |
| JP | A-2004-28037 | | | 1/2004 |
| WO | WO 2006/049231 | A2 | | 5/2006 |
| WO | WO 2006/070596 | A1 | | 7/2006 |

* cited by examiner

FUEL SUPPLY APPARATUS AND FUEL SUPPLY METHOD OF AN INTERNAL COMBUSTION ENGINE

BACKGROUND OF THE INVENTION

1. Field of the Invention

The invention relates to a fuel supply apparatus and a fuel supply method of an internal combustion engine.

2. Description of the Related Art

Japanese Patent Application Publication No. 2000-008997 (hereinafter referred to as "JP-A-2000-008997") describes a fuel supply apparatus that is driven by an internal combustion engine. More specifically, this apparatus is provided with a high-pressure pump having a plunger that is supported so as to move up and down in a cylinder. Because the plunger is driven up and down by a cam formed on a camshaft, fuel is drawn up into a pressurizing chamber, and the fuel is pressurized by the plunger and pumped into a delivery pipe. This delivery pipe is connected to injectors corresponding to each cylinder. Fuel is injected from these injectors into a combustion chamber in each cylinder.

Also, in JP-A-2000-008997, an electromagnetic valve which functions as a fuel delivery amount adjusting mechanism is provided in the high-pressure pump. This electromagnetic valve adjusts the fuel delivery amount from the high-pressure pump based on the operating state of the internal combustion engine (hereinafter simply referred to as "engine operating state"). Incidentally, the high-pressure pump is drivingly connected to an output shaft of the internal combustion engine (hereinafter simply referred to as "engine output shaft"). Therefore, the range within which this electromagnetic valve may adjust the fuel delivery amount changes according to the rotation speed of the engine output shaft.

If an abnormality such as a driving disability occurs with the electromagnetic valve in the high-pressure pump, the fuel delivery amount will no longer be adjusted in the manner described above. In this case, an excessive amount of fuel may be supplied from the high-pressure pump to a fuel line such as the delivery pipe, causing the fuel pressure in the fuel line to increase unnecessarily. Therefore, in this kind of fuel supply apparatus, a relief valve is usually provided in the delivery pipe or the like such that if the fuel pressure in the fuel line reaches or exceeds a relief pressure of the relief valve, fuel will be flow out of the fuel line through the relief valve, thereby reducing the fuel pressure in the fuel line.

However, there is a limit as to just how much the fuel pressure may be reduced by allowing fuel to flow out of the fuel line via the relief valve in this way. Also, if the amount of fuel supplied from the high-pressure pump increases, the fuel pressure in the fuel line becomes extremely high, which may result in fuel leaking from the fuel injector into the combustion chamber in the engine, for example.

Incidentally, problems such as the fuel pressure in the fuel line increasing excessively and fuel leaking from the fuel injection device into the combustion chamber, are not limited to a fuel supply apparatus that employs a plunger type high-pressure pump. These problems may also occur in a fuel supply apparatus that employs another fuel delivery device that is drivingly connected to the engine output shaft.

SUMMARY OF THE INVENTION

The invention provides a fuel supply apparatus and a fuel supply method of an internal combustion engine that suppresses fuel from leaking from a fuel injection device into a combustion chamber, for example, by suppressing an excessive increase in fuel pressure in a fuel line when a fuel delivery amount is no longer be adjusted.

A first aspect of the invention relates to a fuel supply apparatus of an internal combustion engine which includes a fuel delivery amount adjusting mechanism which is drivingly connected to an output shaft of the internal combustion engine, delivers fuel to a fuel injection device through a fuel line, and adjusts the delivery amount of that fuel based on rotation of the output shaft of the internal combustion engine within an adjustable range that changes according to a rotation speed of the output shaft of the internal combustion engine. This fuel supply apparatus of an internal combustion engine further includes: i) abnormality determining means that determines whether an abnormality has occurred in the fuel delivery adjusting mechanism; and ii) rotation speed restricting means that restricts the rotation speed of the output shaft of the internal combustion engine to equal to or less than a predetermined rotation speed when it is determined that there is an abnormality in the fuel delivery amount adjusting mechanism.

According to the fuel supply apparatus of the first aspect, the rotation speed of the output shaft of the internal combustion engine may be restricted to equal to or less than a predetermined rotation speed when the fuel delivery amount is unable to be adjusted by the fuel delivery amount adjusting mechanism. As a result, the fuel delivery amount from the fuel delivery device may be restricted thus enabling the pressure of the fuel in the fuel line to be suppressed from increasing excessively. Also, fuel leakage from the fuel injection device into the combustion chamber and the like may be suppressed.

Incidentally, the fuel supply apparatus of an internal combustion engine may further include a relief valve which is provided in the fuel line and allows some of the fuel in the fuel line to flow out of the fuel line by opening the relief valve when a fuel pressure in the fuel line exceeds a predetermined relief pressure that is lower than a pressure limit value of the fuel line. Also, the rotation speed restricting means may set the predetermined rotation speed a speed at which a pressure of the fuel in the fuel line while the relief valve is open is maintained at a predetermined pressure between the pressure limit value and the predetermined relief pressure.

Restricting the rotation speed of the internal combustion engine (hereinafter simply referred to as "engine speed") to equal to or less than a predetermined rotation speed enables the fuel pressure of the fuel supply apparatus to be suppressed from becoming excessively high. However, if the predetermined rotation speed is set too low, the engine speed will be restricted to a speed lower than is necessary.

Regarding this, the relief valve allows some of the fuel in the fuel line to flow out of the fuel line, and the rotation speed restricting means sets the predetermined rotation speed to the speed at which the fuel pressure of the fuel supply apparatus becomes the predetermined pressure between a predetermined relief pressure of this relief valve and a pressure limit value of the fuel supply apparatus. As a result, the fuel pressure of the fuel supply may be suppressed from becoming excessively high while utilizing the fuel relief function of the relief valve. It may be also possible to avoid the engine speed from being restricted to a speed lower than necessary.

In the foregoing fuel supply apparatus of an internal combustion engine, the rotation speed restricting means may restrict the rotation speed of the output shaft of the internal combustion engine by restricting a fuel injection quantity of the fuel injection device when it is determined that there is an abnormality in the fuel delivery amount adjusting mechanism.

In the foregoing fuel supply apparatus of an internal combustion engine, the rotation speed restricting means may restrict the rotation speed of the output shaft of the internal combustion engine by retarding an ignition timing of a spark plug of the internal combustion engine when it is determined that there is an abnormality in the fuel delivery amount adjusting mechanism. The rotation speed restricting means may restrict the rotation speed of the output shaft of the internal combustion engine by retarding the ignition timing of the spark plug when the fuel pressure in the fuel line exceeds the predetermined pressure. Also, the rotation speed restricting means may restrict the rotation speed of the output shaft of the internal combustion engine by retarding the ignition timing of the spark plug when the fuel pressure in the fuel line is equal to or less than the predetermined pressure and the rotation speed of the output shaft of the internal combustion engine exceeds the predetermined rotation speed. Further, the rotation speed restricting means may restrict the rotation speed of the output shaft of the internal combustion engine by continuing to retard the ignition timing of the spark plug until the rotation speed of the output shaft of the internal combustion engine becomes equal to or less than the predetermined rotation speed.

Also, in the foregoing fuel supply apparatus of an internal combustion engine, the rotation speed restricting means may restrict the rotation speed of the output shaft of the internal combustion engine by changing a valve timing of the internal combustion engine. In the foregoing fuel supply apparatus of an internal combustion engine, the abnormality determining means may determine that there is an abnormality in the fuel delivery amount adjusting mechanism when the fuel pressure in the fuel line exceeds the predetermined pressure.

A second aspect of the invention relates to a fuel supply apparatus of an internal combustion engine which includes a first fuel delivery device which is drivingly connected to an output shaft of the internal combustion engine and delivers fuel through a first fuel line to a first fuel injection device based on rotation of the output shaft of the internal combustion engine. The first fuel injection device injects fuel directly into a combustion chamber of the internal combustion engine. The first fuel delivery device includes a fuel delivery amount adjusting mechanism that adjusts a fuel delivery amount based on an engine operating state within an adjustable range that changes according to the rotation speed of the engine output shaft. The fuel supply apparatus of an internal combustion engine further includes a second fuel injection device that injects fuel into an intake port of the internal combustion engine; a second fuel delivery device which supplies fuel to the second fuel injection device through a second fuel line and supplies fuel to the first fuel delivery device through a fuel supply line; abnormality determining means for determining whether an abnormality has occurred in the fuel delivery amount adjusting mechanism; a switching valve that is provided in the fuel supply line and selectively opens and closes the fuel supply line to the first fuel delivery device; and switching valve controlling means that stops the supply of fuel from the second fuel delivery device to the first fuel delivery device by closing the switching valve when it is determined by the abnormality determining means that there is an abnormality in the fuel delivery amount adjusting mechanism. Also, the fuel delivery amount adjusting mechanism may be an electromagnetic valve.

According to the second aspect of the invention, the pressure of fuel in the first fuel line may be suppressed from becoming excessively high by stopping the supply of fuel from the second fuel delivery device to the first fuel delivery device by closing the switching valve when the fuel delivery amount adjusting mechanism is unable to adjust the fuel delivery amount. Also, the second fuel delivery device and the second fuel injection device for intake port injection may be provided separately from the first fuel delivery device and the first fuel injection device for in-cylinder injection. Therefore, even if the fuel delivery by the first fuel delivery device is stopped such that fuel is no longer able to be injected by the first fuel injection device for in-cylinder injection, fuel may be injected into the intake port via the second fuel injection device for intake port injection so the engine may keep operating.

A third aspect of the invention relates to a fuel supply method of an internal combustion engine that is provided with a fuel delivery amount adjusting mechanism which is drivingly connected to an output shaft of the internal combustion engine and adjusts a fuel delivery amount based on rotation of the output shaft of the internal combustion engine within an adjustable range that changes according to a rotation speed of the output shaft of the internal combustion engine, the fuel supply method for an internal combustion engine. The fuel supply method for an internal combustion engine including: i) supplying fuel through a second fuel line to a second fuel injection device that injects fuel into an intake port of the internal combustion engine, and supplying fuel through a fuel supply line to a first fuel delivery device that delivers fuel through a first fuel line to a first fuel injection device that injects fuel directly into a combustion chamber of the internal combustion engine; ii) determining whether an abnormality has occurred in the fuel delivery amount adjusting mechanism; and iii) stopping the supply of fuel to the first fuel delivery device by closing a switching valve which is provided in the fuel supply line and selectively opens and closes the fuel supply line to the first fuel delivery device when it is determined that there is an abnormality in the fuel delivery amount adjusting mechanism.

A fourth aspect of the invention relates to a fuel supply method of an internal combustion engine that is provided with a fuel delivery amount adjusting mechanism which is drivingly connected to an output shaft of the internal combustion engine and adjusts a fuel delivery amount based on rotation of the output shaft within an adjustable range that changes according to a rotation speed of the output shaft of the internal combustion engine. The fuel supply method for an internal combustion engine includes: i) delivering fuel to a fuel injection device through a fuel line; ii) determining whether an abnormality has occurred in the fuel delivery amount adjusting mechanism; and iii) restricting the rotation speed of the output shaft of the internal combustion engine to equal to or less than a predetermined rotation speed when it is determined that there is an abnormality in the fuel delivery amount adjusting mechanism.

BRIEF DESCRIPTION OF THE DRAWINGS

The foregoing and further objects, features and advantages of the invention will become apparent from the following description of example embodiments with reference to the accompanying drawings, wherein like numerals are used to represent like elements and wherein.

DETAILED DESCRIPTION OF THE PREFERRED EMBODIMENTS

Figure 1:
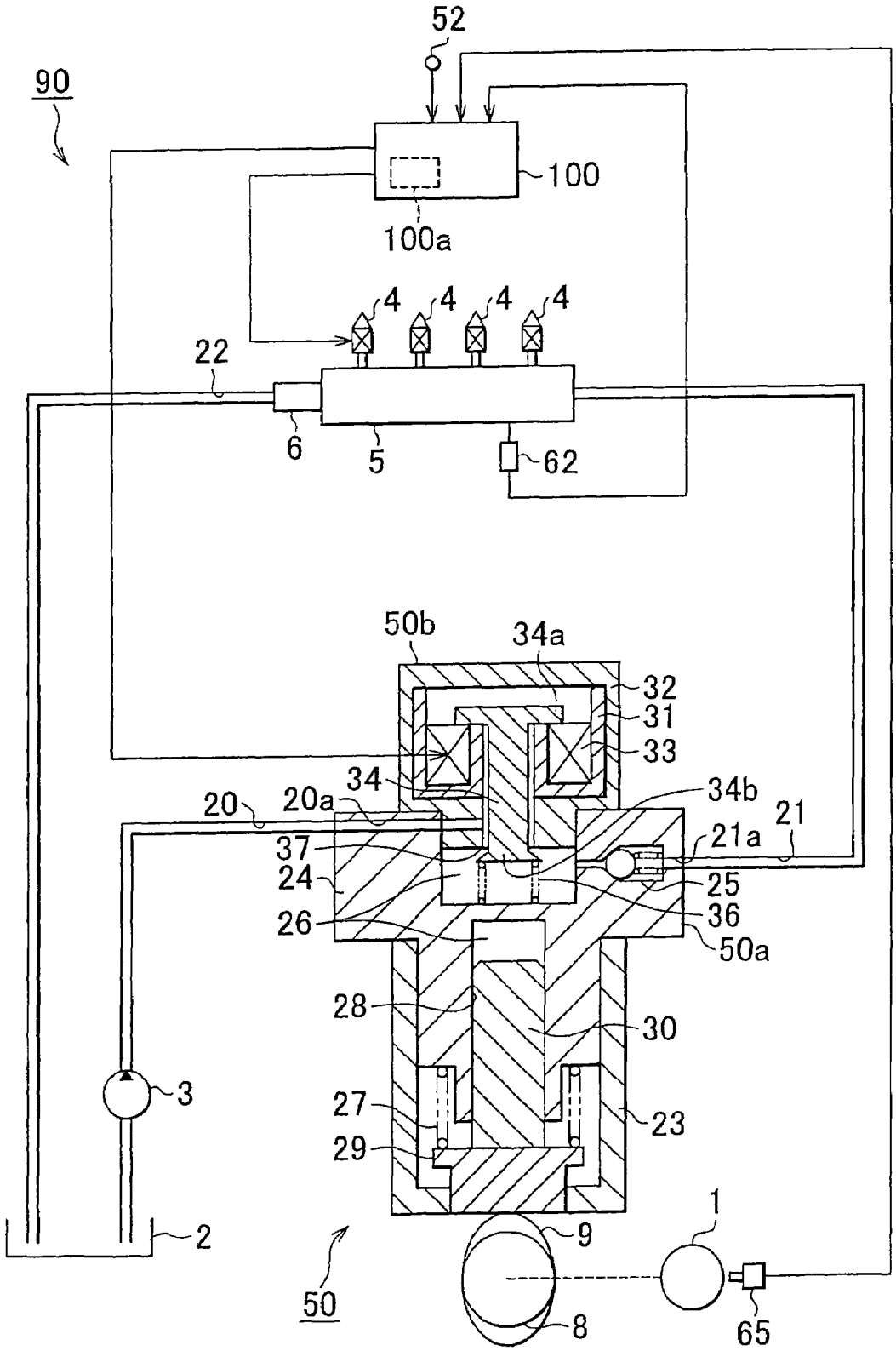
FIG. 1 is a block diagram schematically showing the structure of a fuel supply apparatus of an internal combustion engine according to a first example embodiment of the invention.

Hereinafter, a first example embodiment of a fuel supply apparatus of a four-cylinder direct injection internal combustion engine will be described with reference to FIGS. 1 to 7. FIG. 1 is a block diagram schematically showing the structure of this fuel supply apparatus.

As shown in FIG. 1, a fuel supply apparatus 90 includes a feed pump 3 and a high-pressure pump 50. The feed pump 3 is driven by an electric motor, not shown, and draws up fuel from a fuel tank 2 and supplies the fuel through a low-pressure fuel passage 20 to the high-pressure pump 50. The high-pressure pump 50 is drivingly connected to an engine output shaft 1, and increases the pressure of the fuel supplied by the feed pump 3 and delivers the pressurized fuel through a high-pressure fuel passage 21 to a delivery pipe 5 which is a fuel line.

An injector 4 corresponding to each cylinder is connected to the delivery pipe 5. Fuel in the delivery pipe 5 is injected from the injector 4 into the combustion chamber of each cylinder. A relief valve 6 is also provided in the delivery pipe 5. This relief valve is connected to the fuel tank 2 via a return fuel passage 22. If the fuel pressure in the delivery pipe 5 (hereinafter simply referred to as "fuel pressure P") exceeds a relief pressure PE that is set beforehand, the relief valve 6 opens to allow fuel in the delivery pipe 5 to return to the fuel tank 2 through the return fuel passage 22. Incidentally, this relief pressure PE is set to a value that is smaller than a pressure limit value PL of the fuel line such as the delivery pipe 5.

Also, the fuel supply apparatus 90 is provided with a variety of sensors for detecting the engine operating state. For example, a crank sensor 65 that detects the rotation speed of an engine output shaft 1 (hereinafter simply referred to as "engine speed NE") and rotation phase of the engine output shaft 1, is provided near the engine output shaft 1. An accelerator sensor 52 that detects a depression amount of an accelerator pedal, not shown, (i.e., an opening degree of an accelerator) is provided near the accelerator pedal, and a pressure sensor 62 that detects the fuel pressure P is provided in the delivery pipe 5.

The detection signals of these sensors are received by a control unit 100. This control unit 100 performs overall engine control, i.e., various controls, such as fuel injection control and ignition timing control and the like based on these detection signals, i.e., the engine operating state. Also, the control unit 100 includes memory 100*a* that stores control programs related to the various controls, function maps necessary for executing those controls, and calculation results.

Next, the structure of the high-pressure pump 50 will be described. As shown in FIG. 1, the high-pressure pump 50 is mainly made up of a drive mechanism 50*a* and an electromagnetic valve 50*b*. Here, the electromagnetic valve 50*b* may be regarded as a fuel delivery amount adjusting mechanism of the invention. The drive mechanism 50*a* includes a body 24 and a plunger 30. The body 24 is fixed to a cylinder head, not shown, of the engine. A cylinder 28 is formed inside the body 24 and supports a plunger 30 in a manner that the plunger 30 is able to move up and down. A lifter 29 is fixed to the base portion (the lower end portion in the drawing) of this plunger 30. The side surface of the lifter 29 is slidably supported by a lifter guide 23 that is fixed to the body 24, while the bottom surface of the lifter 29 abuts on a cam 9 formed on a camshaft 8 of the engine. Also, a spring 27 is provided between the body 24 and the lifter 29. Biasing force of the spring 27 biases the lifter 29 and the plunger 30 toward the cam 9. As the camshaft 8 rotates, the plunger 30 is driven up and down by the cam 9. Incidentally, the cam shaft 8 is drivingly connected to the engine output shaft 1 via a rolling drive mechanism such as a chain, and thus rotates together with the engine output shaft 1.

Also, the electromagnetic valve 50*b* includes a housing 32, a core 31, a coil 33, and a valve body 34 made of magnetic material. The housing 32 is attached to the body 24, and the core 31 and the coil 33 are provided inside the housing 32. A pressurizing chamber 26 is divided into two by the housing 32 and the body 24. This pressurizing chamber 26 is communicated with the low-pressure fuel passage 20 via a fuel supply passage 20*a* formed in both of the housing 32 and the body 24, and is communicated with the high-pressure fuel passage 21 via a discharge passage 21*a* formed in the body 24. A check valve 25 is arranged in this discharge passage 21*a*. This check valve 25 restricts the flow (i.e., back-flow) of fuel from the delivery pipe 5 to the pressurizing chamber 26.

A valve portion 34*b* is formed on the tip of the valve body 34. This valve portion 34*b* sticks to or lifts away from a valve seat 37 formed on the peripheral edge of an opening. of the fuel supply passage 20*a* in the housing 32. The opening of the fuel supply passage 20*a* is communicated with the pressurizing chamber 26. A spring 36 is provided between the valve body 34*b* of the valve body 34 and the body 24. This spring 36 biases the valve portion 34*b* of the valve body 34 toward the valve seat 37 such that the valve portion 34*b* sticks to the valve seat 37, thereby closing the electromagnetic valve 50*b*. On the other hand, an armature 34*a* is formed on the base (the. upper end portion in the drawing) of the valve body 34. This armature 34*a* is formed near the core 31. When the coil 33 is energized, electromagnetic force generated in the core 31 draws the armature toward the core 31. As a result, the valve portion 34*b* lifts away from the valve seat 37 against the biasing force of the spring 36, thereby opening the electromagnetic valve 50*b*..

Figure 2:
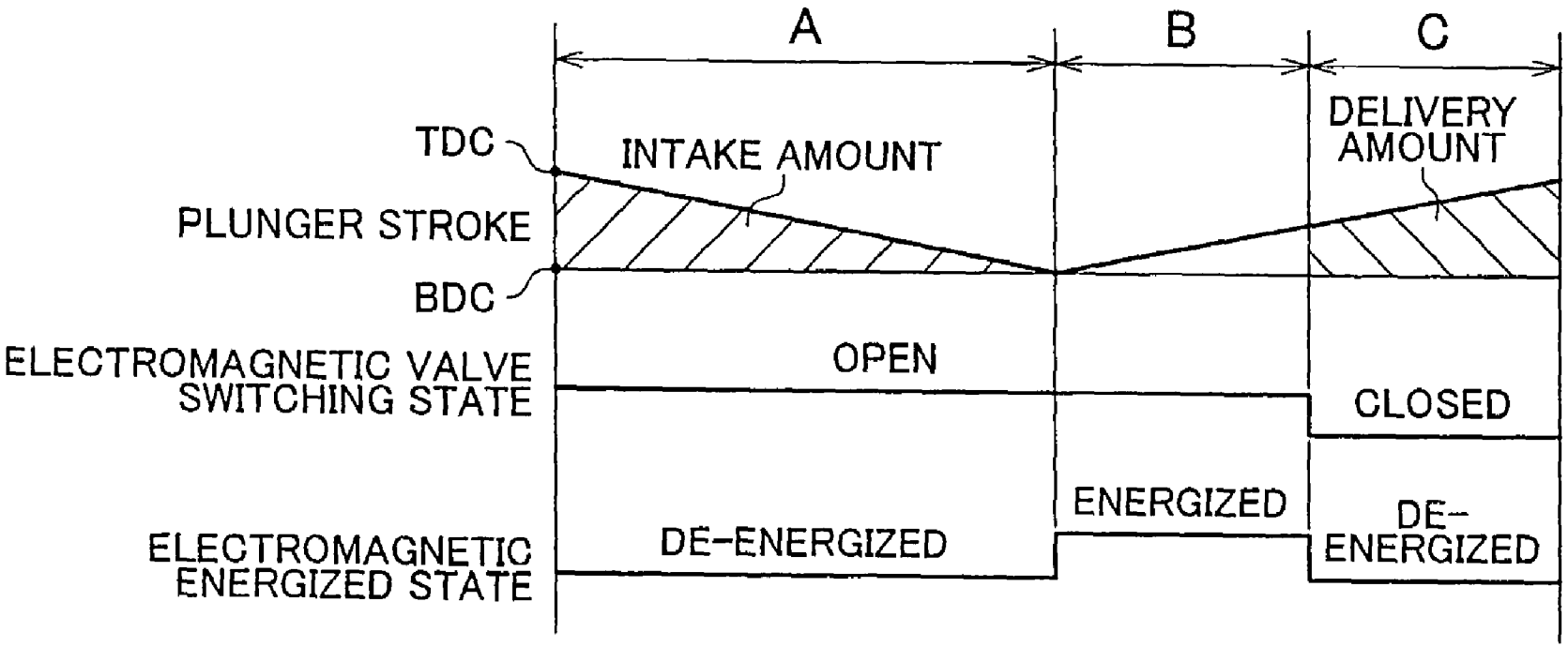
FIG. 2 is a view showing the plunger stroke, the shifts in the open/closed state of an electromagnetic valve, and the energized state of the electromagnetic valve during inhalation and delivery strokes.
Figure 3:
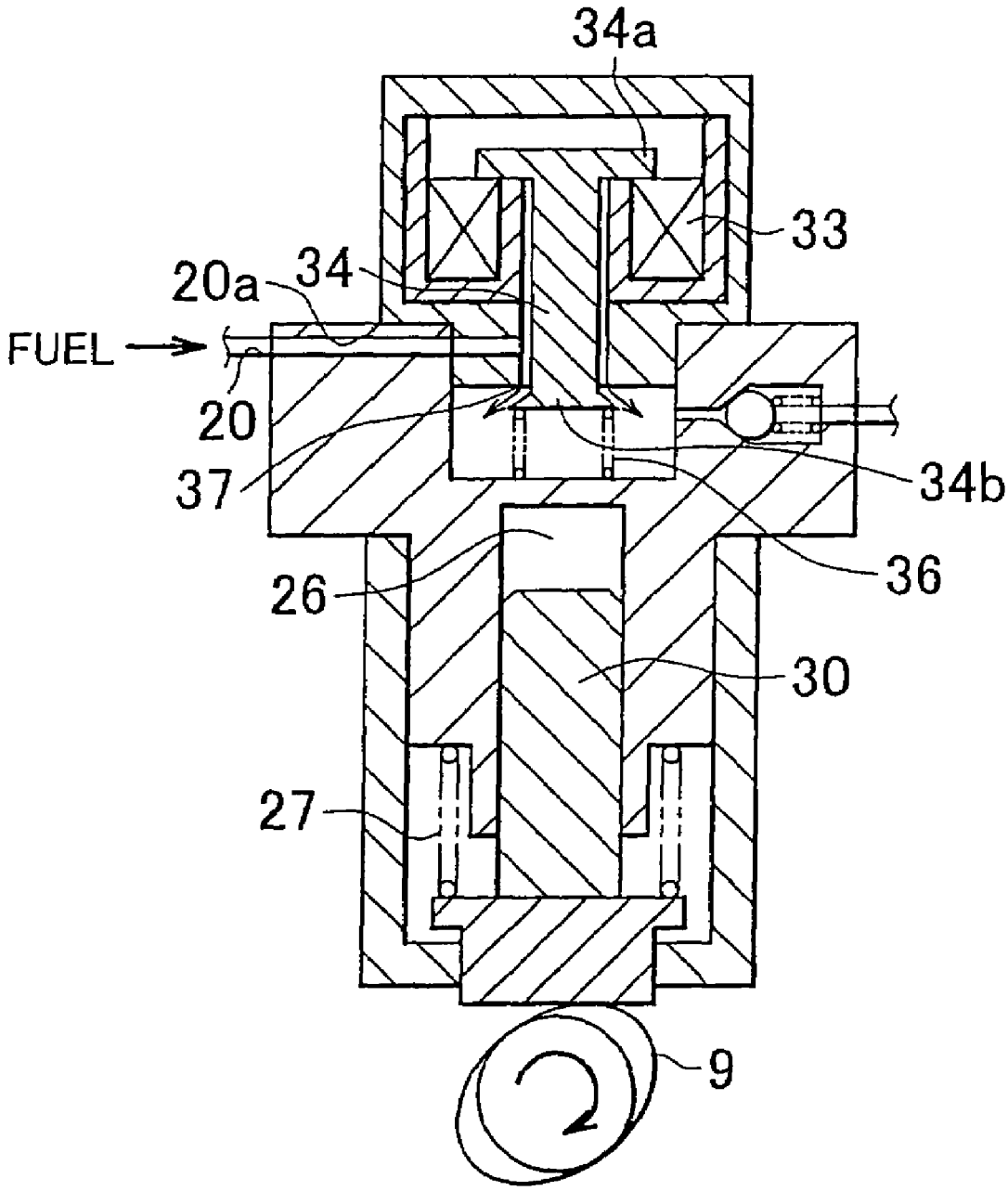
FIG. 3 is a sectional view of a high-pressure pump in the state corresponding to period A in FIG. 2.
Figure 4:
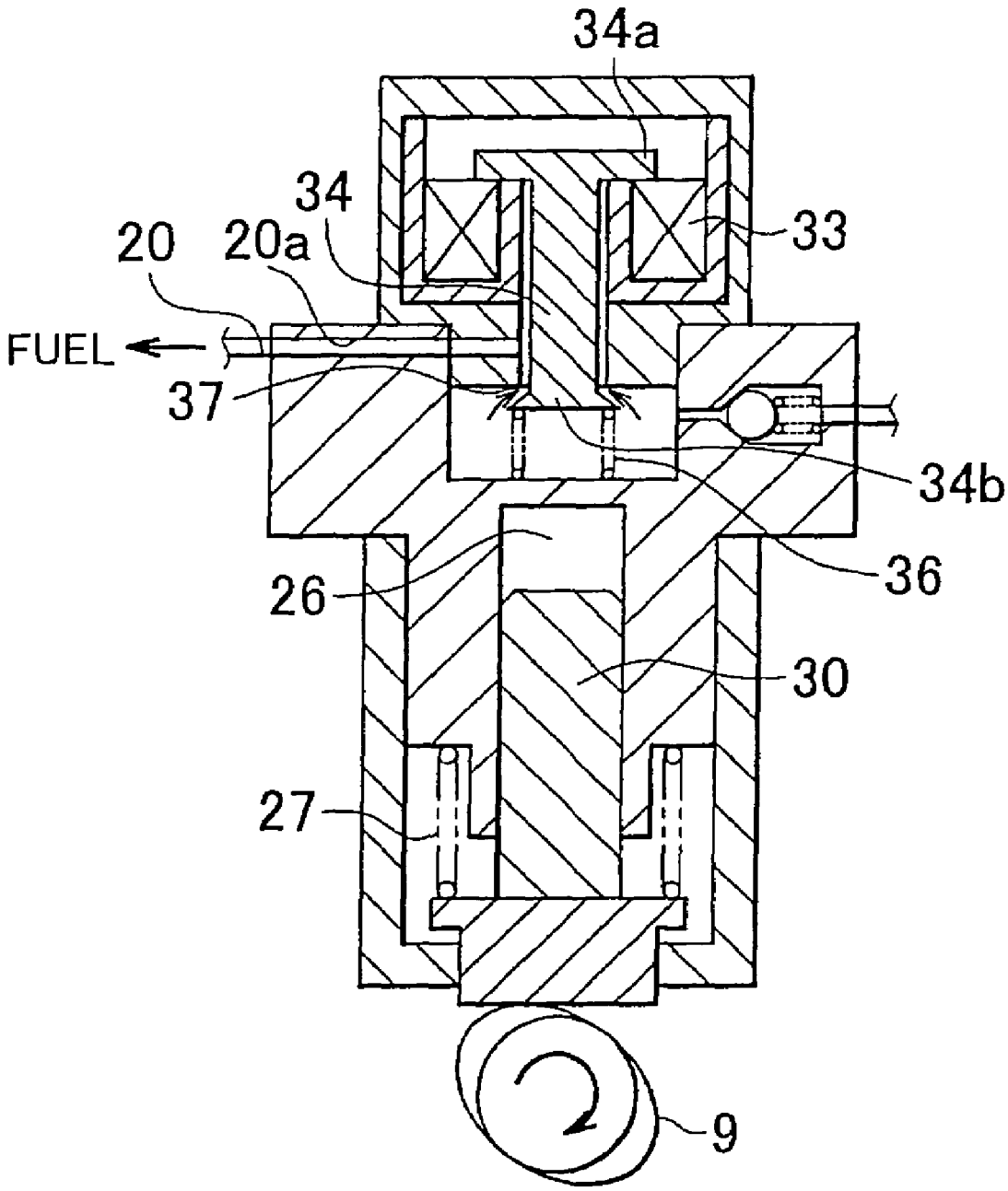
FIG. 4 is a sectional view of the high-pressure pump in the state corresponding to period B in FIG. 2.
Figure 5:
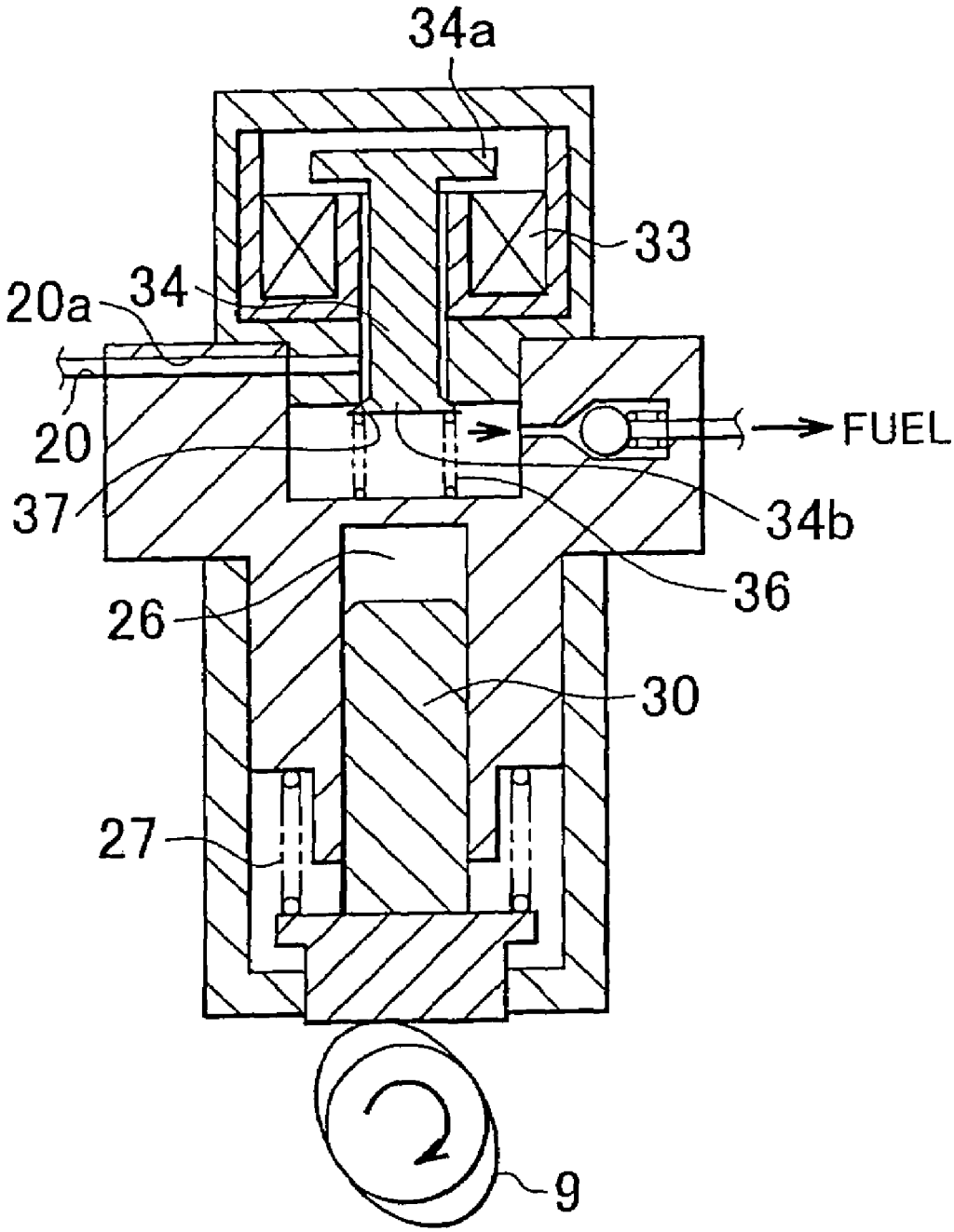
FIG. 5 is a sectional view of the high-pressure pump in the state corresponding to period C in FIG. 2.

This high-pressure pump 50 inhales fuel supplied by the feed pump 3 into the pressurizing chamber 26 (the inhalation stroke), and then pressurizes the inhaled fuel and delivers the pressurized fuel to the delivery pipe 5 (the delivery stroke). Hereinafter, the inhalation and the delivery strokes will be described with reference to FIGS. 2 to 5. FIG. 2 is a view illustrating the strokes of the plunger 30, the open/closed state of the electromagnetic valve 50*b*, and the energized state of the electromagnetic valve 50*b* during the inhalation and delivery strokes. FIGS. 3 to 5 are sectional views showing the high-pressure pump 50 in different states corresponding to each of the periods during the inhalation and delivery strokes.

First, the inhalation stroke will be described. During period A shown in FIG. 2, fuel is inhaled while the plunger 30 is driven from top dead center (TDC; the position at which the lift amount is the greatest) and bottom dead center (BDC; the position at which the lift amount is the smallest). During this period A, the coil 33 is de-energized so the valve portion 34*b* of the valve body 34 is biased toward the valve seat 37 by the spring 36. However, when the plunger 30 is displaced toward the BDC side, the volume of the pressurizing chamber 26 increases so the internal pressure falls. As a result, the valve portion 34*b* of the valve body 34 lifts away from the valve seat 37, thereby opening the electromagnetic valve 50*b* (see FIG. 3). As a result, fuel is introduced into the pressurizing chamber 26 through the low-pressure fuel passage 20 and the fuel supply passage 20*a*.

Next, the delivery stroke will be described. During period B shown in FIG. 2, the coil 33 is energized. As described above, when the coil 33 is energized, the electromagnetic force generated in the core 31 is greater than the biasing force of the spring 36 so the armature 34*a* is drawn towards the core 31, and as a result, the valve portion 34*b* of the valve body 34 is kept away from the valve seat 37, as shown in FIG. 4. As a result, the electromagnetic valve 50*b* is kept open such that fuel in the pressurizing chamber 26 returns to the fuel tank 2 through the fuel supply passage 20*a* and the low-pressure fuel passage 20.

Next, during period C shown in FIG. 2, the coil 33 is de-energized so the valve portion 34*b* of the valve body 34 is biased toward the valve seat 37 by the spring 36. Furthermore, the internal pressure of the pressurizing chamber 26 also increases because the plunger 30 is displaced toward the TDC side. As a result, the valve portion 34*b* of the valve body 34 becomes seated against the valve seat 37, thereby closing the electromagnetic valve 50*b*, as shown in FIG. 5.

Then when the plunger 30 is further displaced toward the TDC side, the check valve 25 opens and the fuel from the pressurizing chamber 26 is delivered to the delivery pipe 5 through the high-pressure fuel passage 21. The amount of the fuel delivered from the high-pressure pump 50 to the delivery pipe 5 in one delivery stroke, corresponds to the amount of decrease in volume of the pressurizing chamber 26 during period C shown in FIG. 2 when the coil 33 is de-energized. Incidentally, the cycle of this delivery stroke is determined by the rotation speed of the cam 9, i.e., by the engine speed NE. Therefore, the adjustable range of the amount of fuel delivered by the high-pressure pump 50 per unit time (hereinafter simply referred to as "fuel delivery amount") changes depending on the engine speed NE.

Here, the control unit 100 adjusts the fuel delivery amount within the adjustable range that is determined according to the engine speed NE, by controlling the amount of the energizing time of the coil 33. Hence, feedback. control of the fuel pressure P in the delivery pipe 5 is performed. More specifically, the control unit 100 sets a target value of an appropriate fuel pressure P based on the engine operating state, and reduces the fuel delivery amount by lengthening the energizing time of the coil 33 during the delivery stroke when the actual value of the fuel pressure P detected by the pressure sensor 62, for example, is greater than the target value. On the other hand, when the actual value is less than the target value, the control unit 100 increases the fuel delivery amount by shortening the energizing time of the coil 33 (i.e., period B) during the delivery stroke.

However, when the coil 33 of the electromagnetic valve 50*b* is unable to be energized due to an abnormality such as a disconnection or the like, all of the fuel that is introduced into the pressurizing chamber 26 during the inhalation stroke, is delivered to the delivery pipe 5. In other words, the fuel delivery amount becomes the maximum within the adjustable range determined by the engine speed NE. As a result, the fuel pressure P may rise excessively.

In this case, if the fuel pressure P exceeds the relief pressure PE of the relief valve 6, fuel in the delivery pipe 5 is able to flow out of the delivery pipe 5 through the relief valve 6. However, although a temporary increase in the fuel pressure is able to be suppressed as a result, an excessive rise in fuel pressure P is unable to be avoided when the fuel delivery amount from the high-pressure pump 50 increases due to an abnormality in the electromagnetic valve 50*b*, as described above.

Therefore, with the fuel supply apparatus 90 according to the first example embodiment, the fuel pressure P may be reliably suppressed from increasing excessively due to an abnormality in the electromagnetic valve 50*b*, by setting an upper limit value for the engine speed NE and restricting the engine speed NE so that the engine speed NE does not exceed this upper limit value. Hereinafter, the steps of a routine for dealing with such an abnormality will be described with reference to the flowchart shown in FIG. 6.

Figure 6:
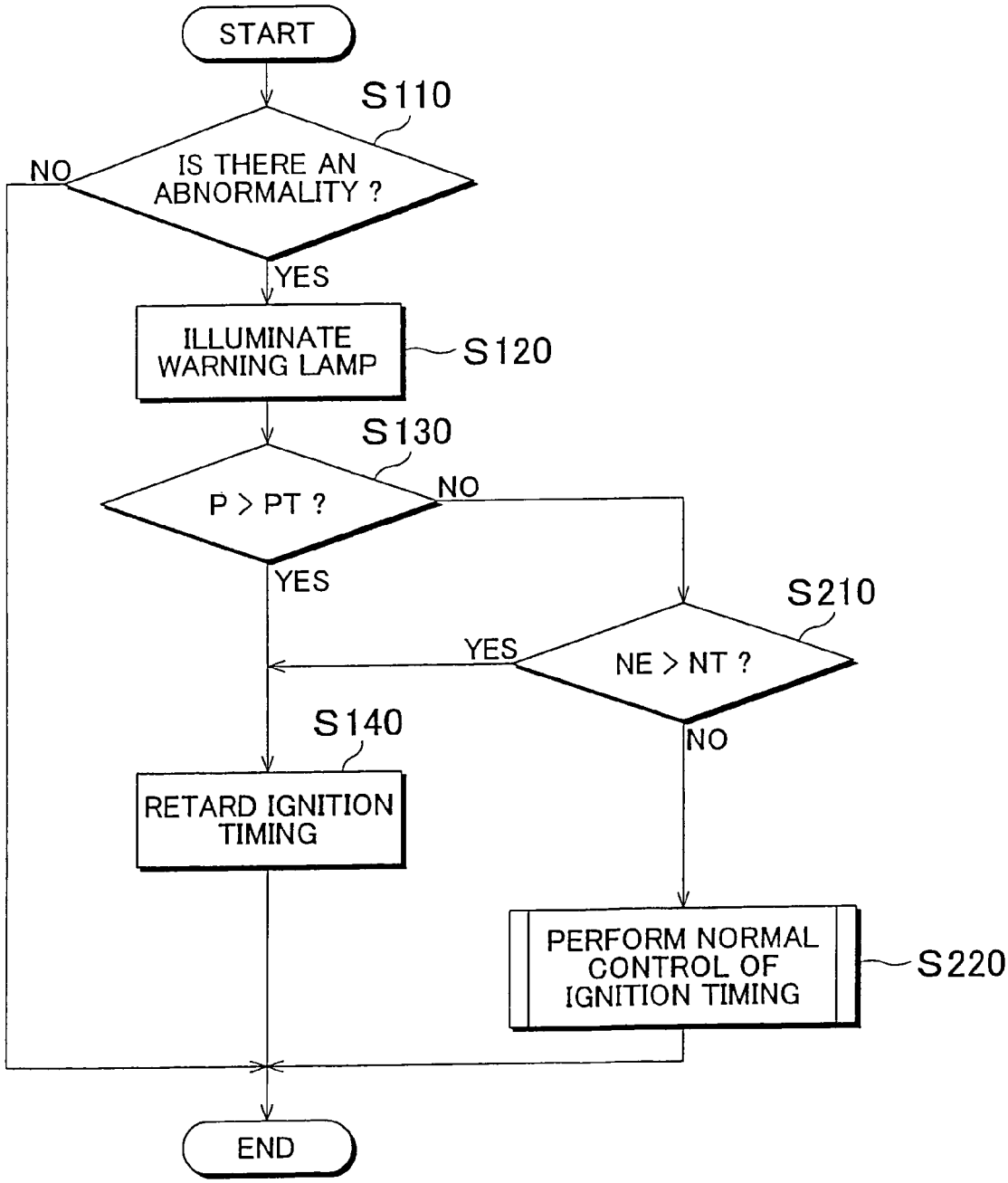
FIG. 6 is a flowchart illustrating steps in a routine for dealing with an abnormality in which the fuel delivery amount is unable to be adjusted according to the first example embodiment.

The routine shown in FIG. 6 is repeatedly executed by the control unit 100 at predetermined control cycles. Here, the control unit 100 may be regarded as abnormality determining means and rotation speed restricting means of the invention. In this routine, the control unit 100 starts to determine whether an abnormality that the electromagnetic valve 50 is unable to perform an adjusting operation, has occurred (S110). More specifically, the control unit 100 may detect whether there is an abnormality that the electromagnetic valve 50*b* is unable to perform an adjusting operation, by monitoring the energized state of the coil 33 using an electric circuit that is provided separately. If it is determined that such an abnormality has not occurred (i.e., NO in step S110), this cycle of the routine ends. If, on the other hand, it is determined that an abnormality has occurred in the electromagnetic valve 50*b* such that the fuel delivery amount is unable to be adjusted (i.e., YES in step S110), a warning lamp provided in the operating panel illuminates (S120) and the process proceeds on to step S130. Here, the control unit 100 may be also regarded as abnormality determining means of the invention.

In step S130, the control unit 100 determines whether the fuel pressure P in the delivery pipe 5 that is detected by the pressure sensor 62 is greater than a reference pressure PT. This reference pressure PT is set beforehand to a value between the relief pressure PE of the relief valve 6 and the pressure limit value PL of the fuel line system of the fuel supply apparatus 90 (i.e., PE<PT<PL), and is stored in the memory 100*a* of the control unit 100. If it is determined that the fuel pressure P is greater than the reference pressure PT (i.e., YES in S130), the process proceeds on to step S140, where retard control is performed on the ignition timing of the spark plug. More specifically, the ignition timing θ that is set based on the engine operating state is retarded by a predetermined retard amount Δθ. Incidentally, this retard amount Δθ of the ignition timing is set to a value that a large shock will not be produced by a reduction in engine output due to the ignition timing retard, and is stored in the memory 100*a*.

If, on the other hand, the fuel pressure P is equal to or less than the reference pressure PT (i.e., NO in step S130), the process proceeds on to step S210. In step S210, the control unit 100 determines whether the engine speed NE detected by the crank sensor 65 is greater than a reference engine speed NT. This reference engine speed NT is set to a value that the fuel pressure P converges and is maintained at the reference pressure PT when fuel stops being injected because of fuel cut control, and is stored in the memory 100*a*.

If it is determined that the engine speed NE is greater than the reference engine speed NT (i.e., YES in step S210), the process proceeds on to step S140, where the retard control of the ignition timing is performed. If, on the other hand, it is determined that the engine speed NE is equal to or less than the reference engine speed NT (i.e., NO in step S210), the process proceeds on to step S220, where normal control of the ignition timing based on the engine operating state is performed, and this cycle of the routine ends.

Figure 7:
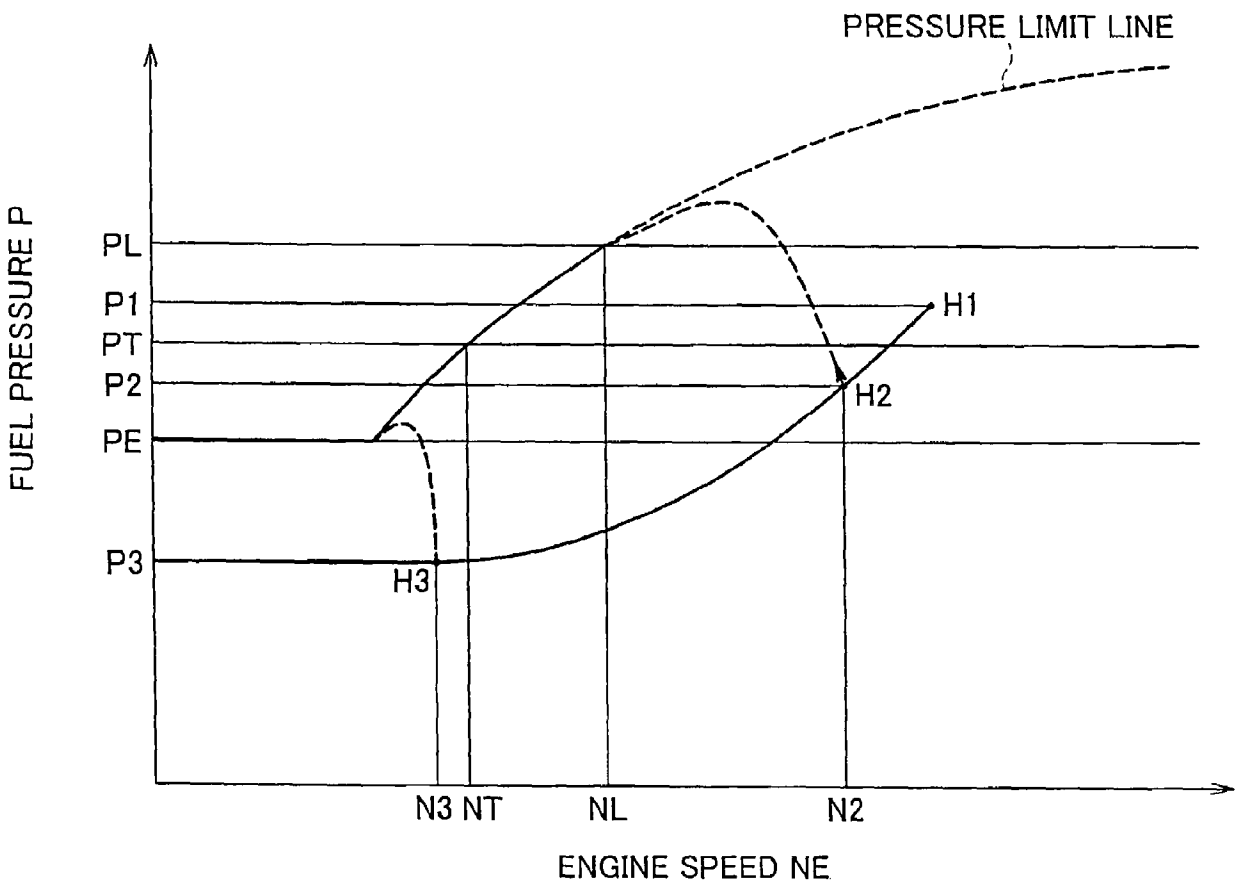
FIG. 7 is a graph showing the relationship between the rotation speed of a crankshaft and the pressure in a delivery pipe when the fuel delivery amount is unable to be adjusted.

Next, the shift in the fuel pressure in the delivery pipe 5 when the routine described above is executed, will be described with reference to FIG. 7. In FIG. 7 the horizontal axis represents the engine speed NE and the vertical axis represents the fuel pressure P in the delivery pipe 5. Also, points H1, H2, and H3 in the graph indicate various fuel delivery states of the fuel supply apparatus 90. Further, a pressure limit line in the graph indicates the maximum amount within the adjustable range of the fuel delivery amount of the high-pressure pump 50, and shows the corresponding relationship between the fuel pressure P and the engine speed NE that maintains the fuel pressure P when fuel cut control is being executed.

For example, when a fuel delivery state of the fuel supply apparatus 90 is as shown by point H1 in FIG. 7, the fuel pressure P (=P1) in the delivery pipe 5 is greater than the reference pressure PT so retard control of the ignition timing is performed as described above. As a result, the output of the engine decreases and the engine speed NE falls. Accordingly, the fuel delivery amount of the high-pressure pump 50 decreases, which in turn results in a lower fuel pressure.

When the fuel delivery state shifts to a state shown by point H2 in the graph, the fuel pressure P (=P2) has changed to less than the reference pressure PT, but the engine speed NE (=N2) is still higher than the reference engine speed NT. In the state shown by point H2, when the fuel injection quantity decreases, such as when fuel cut control is executed, the fuel pressure P may suddenly increase and exceed the reference pressure PT again, as shown in broken line of FIG. 7. Moreover, when the engine speed NE (=N2) is greater than a limit speed NL, the pressure in the delivery pipe 5 may also exceed the pressure limit value PL. Therefore, although the fuel pressure P is less than the reference pressure PT, the retard control of the ignition timing is continued until the engine speed NE becomes equal to or less than the reference engine speed NT.

When the fuel delivery state shifts to a state shown by point H3 in the graph, the fuel pressure P (=P3) becomes less than the reference pressure PT and the engine speed NE (=N3) becomes less than the reference engine speed NT. In the state shown by point H3, even if the fuel cut control is executed, the fuel pressure P does not exceed the reference pressure PT. Therefore, the retard control of the ignition timing is continued until the engine speed NE becomes lower than the reference engine speed NT.

The first example embodiment described above enables the following effects to be achieved. First, when the fuel delivery amount is unable to be adjusted by the electromagnetic valve 50*b*, the engine speed NE is limited to equal to or less than the reference engine speed NT. Accordingly, the fuel delivery amount of the high-pressure pump 50 is restricted, and thereby the fuel pressure in the fuel line such as the delivery pipe 5 may be suppressed from increasing excessively. As a result, fuel is inhibited from leaking from the injector 4 into the combustion chamber, for example.

Also, when such an abnormality occurs in the electromagnetic valve 50*b*, the fuel delivery amount of the high-pressure pump 50 becomes the maximum within the adjustable range that is determined according to the engine speed NE at that time. As a result, problems such as described above are even more likely to occur. However, the occurrence of such problems may be reliably suppressed according to the first example embodiment.

On the other hand, if the reference engine speed NT is set too low, it will end up restricting the engine speed NE to a speed lower than is necessary.

Regarding this, according to the first example embodiment, some of the fuel in the delivery pipe 5 is able to flow out of the delivery pipe 5 by opening the relief valve 6 while engine speed NE is restricted to equal to or less than the speed NT at which the fuel pressure P becomes equal to the reference pressure PT between the relief pressure PE of that relief valve 6 and the pressure limit value PL of the fuel supply apparatus 90. As a result, the fuel pressure of the fuel supply may be suppressed from becoming too high while utilizing the fuel relief function of the relief valve 6, and the engine speed NE may be prevented from being restricted to a speed lower than is necessary.

Further, according to the first example embodiment, because the engine speed NE may be restricted by retarding the ignition timing of the engine as compared to for example, a case that the engine speed NE is restricted by limiting the fuel injection quantity of the injector 4, a decrease of the fuel pressure P due to fuel injection may be suppressed. As a result, the fuel pressure P may be reduced efficiently by reducing the engine speed NE without reducing the fuel injection quantity.

Hereinafter, a second example embodiment of the invention will be described focusing on the differences from the first example embodiment.

In the first example embodiment, an abnormality in which the fuel delivery amount is unable to be adjusted is detected by monitoring whether the coil 33 is energized normally by the electric circuit that is provided separately.

In contrast, in the second example embodiment, it is determined that an abnormality in which the electromagnetic valve 50*b* is incapable of performing an adjusting operation has occurred, on the condition that the fuel pressure P is greater than the reference pressure PT. Next, the routine for dealing with an abnormality in which the fuel delivery amount is unable to be adjusted according to the second example embodiment will be described with reference to the flowchart shown in FIG. 8.

Figure 8:
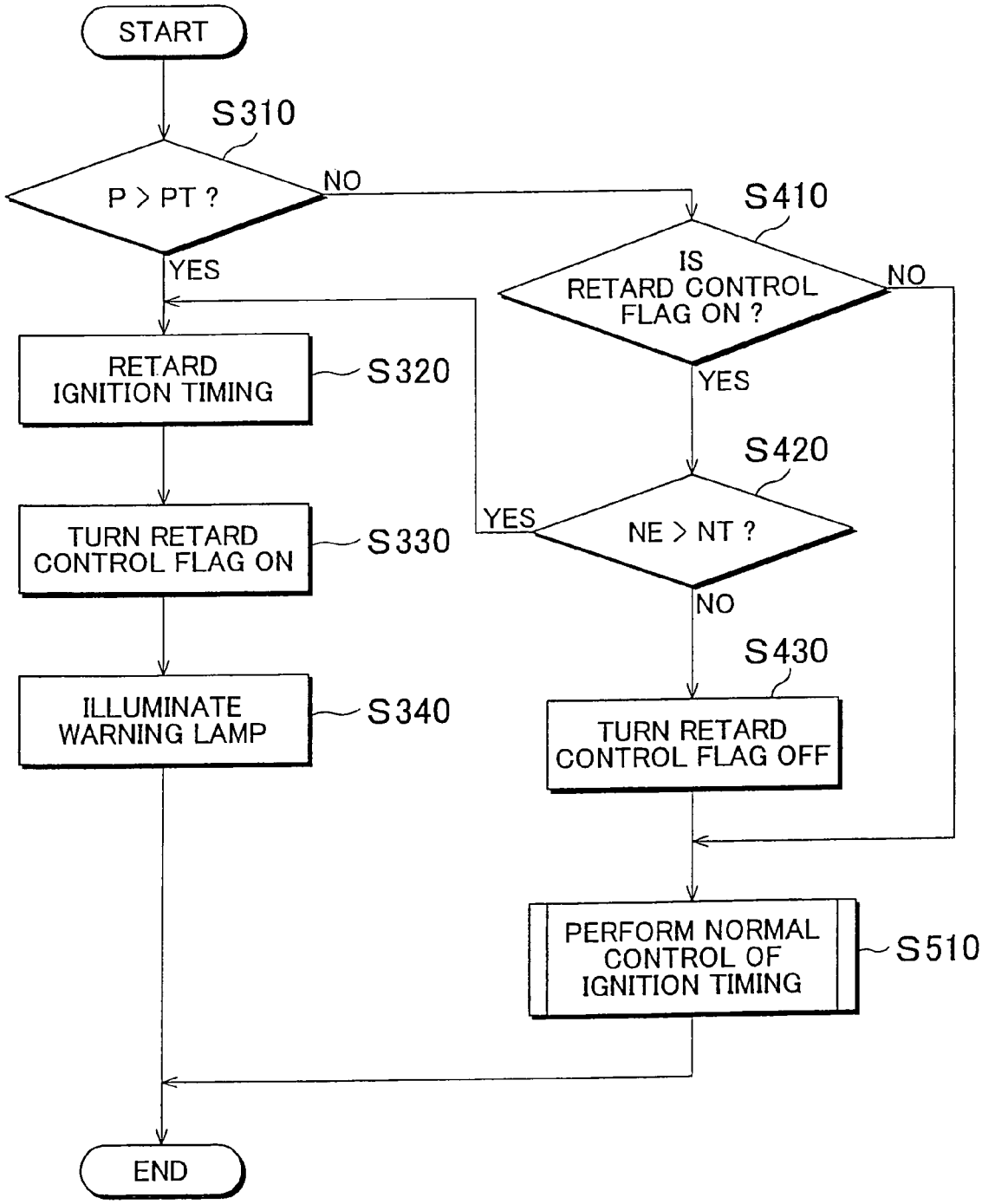
FIG. 8 is a flowchart illustrating steps in a routine for dealing with an abnormality in which the fuel delivery amount is unable to be adjusted according to a second example embodiment of the invention.

As shown in FIG. 8, in this routine, it is first determined whether the fuel pressure P detected by the pressure sensor 62 is greater than the reference pressure PT (S310). If the fuel pressure P is greater than the reference pressure PT (i.e., YES in step S310), it is determined that an abnormality has occurred in the electromagnetic valve 50*b*, and thereby the fuel delivery amount is unable to be adjusted. The process then proceeds on to step S320, where the ignition timing set based on the engine operating state is retarded, just as in step S120 in FIG. 6 described above. Then retard control flag is set to "ON" (S330) and a warning lamp provided in an operating panel is illuminated (S340), after which this cycle of the routine ends. The retard control flag here is a flag that indicates whether it is necessary to execute retard control of the ignition timing due to an abnormality of the electromagnetic valve 50*b*.

If, on the other hand, the fuel pressure P is equal to or less than the reference pressure PT, the process proceeds on to step S410, where it is determined whether the retard control flag is on. If the retard control flag is not on (i.e., NO in step S410), it is determined that there is no need to execute the retard control of the ignition timing due to an abnormality in which the electromagnetic valve 50*b* is incapable of being adjusted, and the process proceeds on to step S510. In step S510, normal control of the ignition timing based on the engine operating state is started, after which this cycle of the routine ends. If, on the other hand, the retard control flag is on (i.e., YES in step S410), the process proceeds on to step S420, where it is determined whether the engine speed NE is greater than the reference engine speed NT.

When the engine speed NE is greater than the reference engine speed NT (i.e., YES in step S420), even if the fuel pressure P is less than the reference pressure PT as shown by point H2 in FIG. 7, the pressure in a fuel pipe such as the delivery pipe 5 may suddenly increase and exceed the pressure limit value PL when the fuel injection quantity decreases. Accordingly, the process proceeds on to step S320, where the retard control of the ignition timing is executed again. If, on the other hand, the engine speed NE is equal to or less than the reference engine speed NT (i.e., NO in step S420), then even if the fuel injection quantity is set to the minimum, the pressure in the delivery pipe 5 still will not exceed the reference pressure PT so the retard control flag is set to "OFF" (S430). Then normal control of the ignition timing based on the engine operating state is started (S510) and this cycle of the routine ends.

The same effects achieved by the first example embodiment may also be achieved with the second example embodiment described above.

Figure 9:
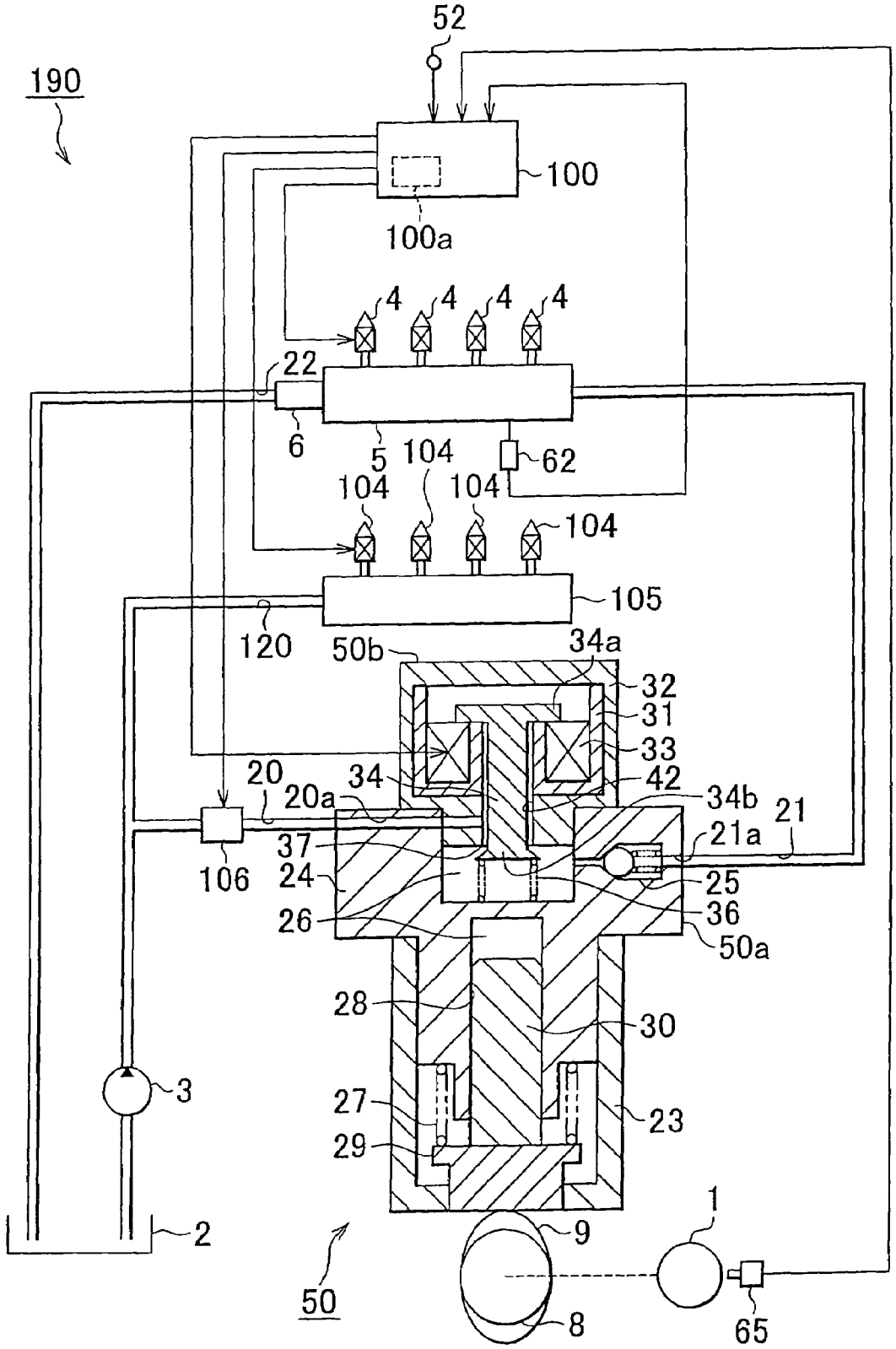
FIG. 9 is a block diagram schematically showing the structure of a fuel supply apparatus of an internal combustion engine according to a third example embodiment of the invention.

Hereinafter, a third example embodiment of the invention will be described with reference to FIG. 9 with a focus on the differences from the first example embodiment. FIG. 9 is a block diagram schematically showing the structure of a fuel supply apparatus 190 according to the third example embodiment.

In the first example embodiment, fuel that is delivered to the delivery pipe 5 by the high-pressure pump 50 as a high-pressure fuel delivery device, is injected directly into the combustion chambers of the engine via the injector 4. However, in the third example embodiment, port-injection fuel supplying means that supplies fuel into an intake port of the engine, is provided separately from this kind of in-cylinder direct-injection fuel supplying means.

As shown in FIG. 9, a fuel supply passage 120 is connected to the low-pressure fuel passage 20 as well as connected to a low-pressure delivery pipe 105. The delivery pipe 5 may be regarded as a first fuel line of the invention and the low-pressure delivery pipe 105 may be regarded as a second fuel line of the invention. An intake port injector 104 corresponding to an intake port of each cylinder of the engine is connected to this low-pressure delivery pipe 105. The injector 4 may be regarded as a first fuel injection device of the invention and the intake port injector 104 may be regarded as a second fuel injection device of the invention. Fuel that is delivered to the low-pressure delivery pipe 105 through the low-pressure fuel passage 20 and the fuel supply passage 120 by the feed pump 3, is injected into each intake port from the intake port injector 104. Here, the high-pressure pump 50 may be regarded as a first fuel delivery device and the feed pump 3 may be regarded as a second fuel delivery device. Incidentally, the control unit 100 determines the amount of fuel to be injected from the intake port injector 104 based on the engine operating state, just as the amount of fuel to be injected from the injector 4.

Also, a switching valve 106 that is controlled by the control unit 100 is provided on the upstream side of the high-pressure pump 50 in the low-pressure fuel passage 20. The control unit 100 controls such that the switching valve 106 opens or closes, and thereby communicating or blocking between the discharge port of the feed pump 3 and the fuel supply passage 20*a* of the high-pressure pump 50, is switched.

When there is no abnormality in which the electromagnetic valve 50*b* is incapable of being adjusted, the control unit 100 controls to open the switching valve 106, and thereby the low-pressure fuel passage 20 communicates with the fuel supply passage 20*a*. Then the control unit 100 selects the in-cylinder direct-injection fuel supplying means and/or the port-injection fuel supplying means, depending on the engine operating state. For example, when the engine load is relatively small, both the in-cylinder direct-injection fuel supplying means and the port-injection fuel supplying means may be used to improve fuel efficiency and reduce emissions. On the other hand, when the engine load is relatively large, only the in-cylinder direct-injection fuel supplying means may be used to improve output performance.

If, on the other hand, an abnormality in which the electromagnetic valve 50*b* is incapable of being adjusted is detected, the control unit 100 controls to close the switching valve 106, and thereby the fuel supply passage 20*a* of the high-pressure pump 50 is blocked. As a result, fuel that is supplied by the feed pump 3 is not introduced into the pressurizing chamber 26 of the high-pressure pump 50 through the fuel supply passage 20*a*. Accordingly, the high-pressure pump 50 is no longer able to deliver fuel to the delivery pipe 5 so fuel injection by the injector 4 stops and fuel is supplied to each cylinder using only the port-injection fuel supplying means.

The third example embodiment described above enables the following effects to be achieved. When the electromagnetic valve 50*b* is unable to adjust the fuel delivery amount, the switching valve 106 is closed to stop the supply of fuel from the feed pump 3 to the high-pressure pump 50. As a result, the fuel pressure in a fuel line subject to high pressure, such as the delivery pipe 5, may be suppressed from increasing excessively. Also, the intake port injector 104 and the feed pump 3 are provided separately from the injector 4 and the high-pressure pump 50. Therefore, even if the fuel delivery by the high-pressure pump 50 is stopped and fuel is no longer able to be injected by the injector 4, fuel may still be injected into the intake port via the intake port injector 104, thus enabling the engine to keep operating.

The example embodiments described above may also be modified as follows. In the first example embodiment, the electric circuit provided separately functions as abnormality determining means that detects an abnormality in which the electromagnetic valve 50*b* is incapable of being adjusted, by monitoring whether the coil 33 is energizing normally. Alternatively, an abnormality in which the electromagnetic valve 50*b* is incapable of being adjusted may be detected based on a tendency of deviation between the actual value of the fuel pressure P in the delivery pipe 5 and a target value when feedback control of the fuel pressure P in the delivery pipe 5 is executed by the control unit 100. More specifically, it may be determined that there is an abnormality in which the high-pressure pump 50 is incapable of being adjusted if the actual value continues to increase and deviates from the target value although the control unit 100 lengthens the energizing time (i.e., period B) of the coil 33 when the actual value of the fuel pressure P detected by the pressure sensor 62 is greater than the target value.

Incidentally, in the first example embodiment, the ignition timing is retarded on the condition that the fuel pressure P is greater than the reference pressure PT (i.e., YES in step S130). Also, the ignition timing is controlled normally on the conditions that the fuel pressure P is equal to or less than the reference pressure PT (i.e., NO in step S130) and the engine speed NE is equal to or less than the reference engine speed NT (i.e., NO in step S210).

Figure 10:
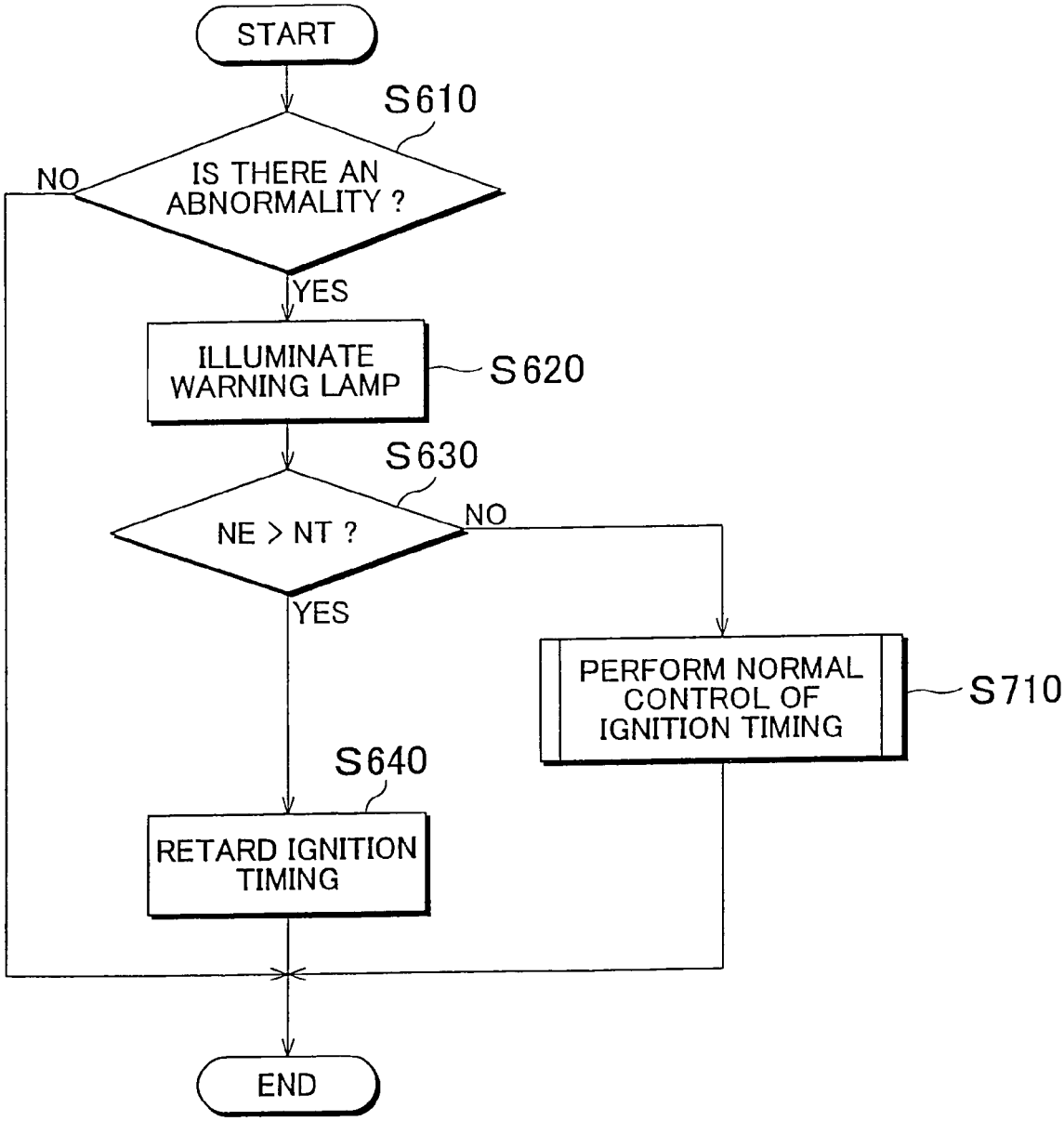
FIG. 10 is a flowchart illustrating a modified example of the steps in the routine for dealing with an abnormality in which the fuel delivery amount is unable to be adjusted.

Alternatively, as shown in FIG. 10, the ignition timing may be retarded on the condition that the engine speed NE is greater than the reference engine speed NT (i.e., YES in step S630), while normal control of the ignition timing may be performed on the condition that the engine speed NE is equal to or less than the reference engine speed NT (i.e., NO in S630).

In the example embodiments described above, the engine speed NE is restricted by retarding the ignition timing of the engine. Alternatively, however, the engine speed NE may be restricted by changing the valve timing of the engine to reduce engine output. The engine speed NE may also be restricted by reducing the fuel injection quantity of the engine.

In the example embodiments described above, the engine speed NE is restricted to equal to or less than the reference engine speed NT at which the fuel pressure P is maintained at the reference pressure PT between the relief pressure PE of the relief valve 6 and the pressure limit value of the fuel supply apparatus 90. Alternatively, however, the engine speed NE may be restricted to a prescribed engine speed NB at which the fuel pressure P becomes a prescribed pressure PB that is lower than the relief pressure PE.

In the example embodiments described above, the fuel supply apparatus 90 employs the electromagnetic valve 50*b* in which the fuel delivery amount becomes the maximum within the adjustable range that is set according to the engine speed NE when an abnormality in which the electromagnetic valve 50*b* is incapable of being adjusted has occurred. Alternatively, an electromagnetic valve 50*b* may be employed in which the fuel delivery amount does not always become the maximum within the adjustable range when an abnormality in which the high-pressure pump 50 is incapable of being adjusted has occurred.

In the example embodiments described above, an example in which the electromagnetic 50*b* is unable to be energized due to a disconnection of the coil 33 is given as the abnormality in which the electromagnetic valve 50*b* is unable to perform adjusting. Alternatively, however, even if the electromagnetic valve 50*b* is unable to perform adjusting due to another type of failure such as the inability to drive the valve body 34 due to foreign matter stuck in the electromagnetic valve 50*b*, for example, an excessive increase in the pressure of the fuel in the delivery pipe 5 may be suppressed in the same manner.

In the example embodiments described above, the reference engine speed NT is set to an engine speed that maintains the fuel pressure P at the reference pressure PT when fuel injection is stopped, i.e., when the fuel injection quantity is set to zero, through fuel cut control.

Alternatively, for example, the restriction on the engine speed may be released by setting the reference engine speed NT to an engine speed that maintains the fuel pressure P at the reference pressure PT when the fuel injection quantity is set to the minimum injection quantity (i.e., an injection quantity corresponding to the minimum injection time) of the injector 4.

In the example embodiments described above, the fuel supply apparatus 90 employs the high-pressure pump 50 that delivers fuel by changing the lift amount of the plunger 30. Alternatively, however, the fuel supply apparatus may employ another type of pump that is drivingly connected to the engine output shaft, such as a vane pump, for example.

While the invention has been described with reference to example embodiments thereof, it is to be understood that the invention is not limited to the exemplary embodiments or constructions. To the contrary, the invention is intended to cover various modifications and equivalent arrangements. In addition, while the various elements of the example embodiments are shown in various combinations and configurations, other combinations and configurations, including more, less or only a single element, are also within the spirit and scope of the invention.

The invention claimed is:

1. A fuel supply apparatus of an internal combustion engine that includes a fuel delivery amount adjusting mechanism which is drivingly connected to an output shaft of the internal combustion engine, the fuel delivery amount adjusting mechanism delivering fuel to a fuel injection device through a fuel line, and adjusting the delivery amount of the fuel based on rotation of the output shaft of the internal combustion engine within an adjustable range that changes according to a rotation speed of the output shaft of the internal combustion engine, the fuel supply apparatus of an internal combustion engine comprising:

abnormality determining means that determines whether an abnormality has occurred in the fuel delivery amount adjusting mechanism; and rotation speed restricting means that restricts the rotation speed of the output shaft of the internal combustion engine to equal to or less than a predetermined rotation speed when it is determined that there is an abnormality in the fuel delivery amount adjusting mechanism, wherein the rotation speed restricting means restricts the rotation speed of the output shaft of the internal combustion engine by changing a valve timing of the internal combustion engine when it is determined that there is an abnormality in the fuel delivery amount adjusting mechanism, the fuel delivery amount adjusting mechanism includes an electromagnetic valve, the abnormality in the fuel delivery amount adjusting mechanism, determined by the abnormality determining means, is an abnormality in operation of the electromagnetic valve, and the electromagnetic valve adjusts the delivery amount of the fuel to control a fuel pressure in the fuel line to which the fuel injection device is connected.

2. The fuel supply apparatus of an internal combustion engine according to claim 1, wherein the fuel delivery amount becomes the maximum within the adjustable range when it is determined that there is an abnormality in the fuel delivery amount adjusting mechanism.

3. The fuel supply apparatus of an internal combustion engine according to claim 2, further comprising:

a relief valve that is provided in the fuel line and allows some of the fuel in the fuel line to flow out of the fuel line by opening the relief valve when a fuel pressure in the fuel line exceeds a predetermined relief pressure that is lower than a pressure limit value of the fuel line, wherein the rotation speed restricting means sets the predetermined rotation speed to a speed at which a pressure of the fuel in the fuel line while the relief valve is open is maintained at a predetermined pressure between the pressure limit value and the predetermined relief pressure.

4. The fuel supply apparatus of an internal combustion engine according to claim 1, wherein the electromagnetic valve has a coil, and the abnormality determining means determines the whether the abnormality has occurred in the fuel delivery amount adjusting mechanism based on an energizing state of the coil.

5. The fuel supply apparatus of an internal combustion engine according to claim 1, wherein the abnormality determining means determines whether an abnormality has occurred in the fuel delivery amount adjusting mechanism based on a fuel pressure at an outlet side of the fuel supply apparatus.

6. The fuel supply apparatus of an internal combustion engine according to claim 1, wherein the electromagnetic valve is provided as part of a high-pressure pump.

7. A fuel supply method of an internal combustion engine that is provided with a fuel delivery amount adjusting mechanism which is drivingly connected to an output shaft of the internal combustion engine and adjusts a fuel delivery amount based on rotation of the output shaft within an adjustable range that changes according to a rotation speed of the output shaft of the internal combustion engine, the fuel supply method for an internal combustion engine comprising:

delivering fuel to a fuel injection device through a fuel line;

determining whether an abnormality has occurred in the fuel delivery amount adjusting mechanism; and restricting the rotation speed of the output shaft of the internal combustion engine to equal to or less than a predetermined rotation speed when it is determined that there is an abnormality in the fuel delivery amount adjusting mechanism, wherein the rotation speed of the output shaft of the internal combustion engine is restricted by retarding an ignition timing of a spark plug of the internal combustion engine when it is determined that there is an abnormality in the fuel delivery amount adjusting mechanism, wherein the fuel delivery amount adjusting mechanism includes an electromagnetic valve, the determining whether the abnormality has occurred in the fuel delivery amount adjusting mechanism is determining whether an abnormality has occurred in operation of the electromagnetic valve, and the electromagnetic valve adjusts the delivery amount of the fuel to control a fuel pressure in the fuel line to which the fuel injection device is connected.

8. The fuel supply method of an internal combustion engine according to claim 7, wherein the electromagnetic valve has a coil, and whether the abnormality has occurred in the fuel delivery amount adjusting mechanism is determined based on an energizing state of the coil.

9. The fuel supply method of an internal combustion engine according to claim 7, wherein it is determined whether an abnormality has occurred in the fuel delivery amount adjusting mechanism based on a fuel pressure at an outlet side of a fuel supply apparatus.

10. The fuel supply method of an internal combustion engine according to claim 7, wherein the electromagnetic valve is provided as part of a high-pressure pump.

11. A fuel supply apparatus of an internal combustion engine, comprising:

a fuel injection device;

a fuel line;

a fuel delivery amount adjusting mechanism that is drivingly connected to an output shaft of the internal combustion engine, delivers fuel to the fuel injection device through the fuel line, and adjusts the delivery amount of the fuel based on rotation of the output shaft of the internal combustion engine within an adjustable range that changes according to a rotation speed of the output shaft of the internal combustion engine;

an abnormality determining portion that determines whether an abnormality has occurred in the fuel delivery amount adjusting mechanism; and a rotation speed restricting portion that restricts the rotation speed of the output shaft of the internal combustion engine to equal to or less than a predetermined rotation speed when it is determined by the abnormality determining portion that there is an abnormality in the fuel delivery amount adjusting mechanism, wherein the rotation speed restricting portion restricts the rotation speed of the output shaft of the internal combustion engine by retarding an ignition timing of a spark plug of the internal combustion engine when it is determined that there is an abnormality in the fuel delivery amount adjusting mechanism, wherein the fuel delivery amount adjusting mechanism includes an electromagnetic valve, the abnormality in the fuel delivery amount adjusting mechanism, determined by the abnormality determining portion, is an abnormality in operation of the electromagnetic valve, and the electromagnetic valve adjusts the delivery amount of the fuel to control a fuel pressure in the fuel line to which the fuel injection device is connected.

12. The fuel supply apparatus of an internal combustion engine according to claim 11, wherein the fuel delivery amount becomes the maximum within the adjustable range when it is determined that there is an abnormality in the fuel delivery amount adjusting mechanism.

13. The fuel supply apparatus of an internal combustion engine according to claim 12, further comprising:

a relief valve that is provided in the fuel line and allows some of the fuel in the fuel line to flow out of the fuel line by opening the relief valve when a fuel pressure in the fuel line exceeds a predetermined relief pressure that is lower than a pressure limit value of the fuel line, wherein the rotation speed restricting means sets the predetermined rotation speed to a speed at which a pressure of the fuel in the fuel line while the relief valve is open is maintained at a predetermined pressure between the pressure limit value and the predetermined relief pressure.

14. The fuel supply apparatus of an internal combustion engine according to claim 13, wherein the rotation speed restricting means restricts the rotation speed of the output shaft of the internal combustion engine by retarding the ignition timing of the spark plug when the fuel pressure in the fuel line exceeds the predetermined pressure after it is determined that there is an abnormality in the fuel delivery amount adjusting mechanism.

15. The fuel supply apparatus of an internal combustion engine according to claim 13, wherein the rotation speed restricting means restricts the rotation speed of the output shaft of the internal combustion engine by retarding the ignition timing of the spark plug when the fuel pressure in the fuel line is equal to or less than the predetermined pressure and the rotation speed of the output shaft of the internal combustion engine exceeds the predetermined rotation speed after it is determined that there is an abnormality in the fuel delivery amount adjusting mechanism.

16. The fuel supply apparatus of an internal combustion engine according to claim 15, wherein the rotation speed restricting means continues to retard the ignition timing of the spark plug until the rotation speed of the output shaft of the internal combustion engine becomes equal to or less than the predetermined rotation speed.

17. The fuel supply apparatus of an internal combustion engine according to claim 13, wherein the abnormality determining means determines that there is an abnormality in the fuel delivery amount adjusting mechanism when the fuel pressure in the fuel line exceeds a predetermined pressure.

18. The fuel supply apparatus of an internal combustion engine according to claim 11, wherein the electromagnetic valve has a coil, and the abnormality determining portion determines whether the abnormality has occurred in the fuel delivery amount adjusting mechanism based on an energizing state of the coil.

19. The fuel supply apparatus of an internal combustion engine according to claim 11, wherein the abnormality determining portion determines whether an abnormality has occurred in the fuel delivery amount adjusting mechanism based on a fuel pressure at an outlet side of the fuel supply apparatus.

20. The fuel supply apparatus of an internal combustion engine according to claim 11, wherein the electromagnetic valve is provided as part of a high-pressure pump.

* * * * *